US008062567B2

(12) United States Patent
Watanabe et al.

(10) Patent No.: US 8,062,567 B2
(45) Date of Patent: Nov. 22, 2011

(54) PROCESS FOR MANUFACTURING ORGANIC FIBERS CONTAINING INORGANIC COMPONENT AND NONWOVEN FABRIC CONTAINING THE SAME

(75) Inventors: Rie Watanabe, Ibaraki (JP); Takashi Tarao, Ibaraki (JP); Masaaki Kawabe, Ibaraki (JP)

(73) Assignee: Japan Vilene Company, Ltd., Tokyo (JP)

( * ) Notice: Subject to any disclaimer, the term of this patent is extended or adjusted under 35 U.S.C. 154(b) by 0 days.

(21) Appl. No.: 12/420,304

(22) Filed: Apr. 8, 2009

(65) Prior Publication Data

US 2009/0253328 A1 Oct. 8, 2009

(30) Foreign Application Priority Data

Apr. 8, 2008 (JP) ..... 2008-099918

(51) Int. Cl.
*B29C 47/00* (2006.01)
*D04H 13/00* (2006.01)
*H05B 6/00* (2006.01)

(52) U.S. Cl. ..... 264/176.1; 264/465; 425/378.2; 425/174.8 R

(58) Field of Classification Search ..... 264/176.1, 264/405, 464, 465; 425/378.2, 174.8 R, 425/174.8 E
See application file for complete search history.

(56) References Cited

U.S. PATENT DOCUMENTS 3,652,749 A * 3/1972 Jae et al. ..... 264/622
6,723,770 B2 * 4/2004 Kuramoto et al. ..... 524/262
2002/0123592 A1 * 9/2002 Zhang et al. ..... 528/10
2003/0045675 A1 * 3/2003 Shioyama et al. ..... 528/480
2007/0018361 A1 * 1/2007 Xu ..... 264/465
2007/0026143 A1 * 2/2007 Campbell ..... 427/180
2007/0048348 A1 * 3/2007 Atanasoska et al. ..... 424/423
2007/0149759 A1 * 6/2007 Yamada et al. ..... 528/310
2008/0093016 A1 * 4/2008 Lee et al. ..... 156/242

(Continued)

FOREIGN PATENT DOCUMENTS

CN 101545158 A 9/2009

(Continued)

OTHER PUBLICATIONS

European Search Report dated Jun. 22, 2011of application No. EP 09157466, the corresponding European patent application.

(Continued)

*Primary Examiner* — Joseph Del Sole
*Assistant Examiner* — Nahida Sultana
(74) *Attorney, Agent, or Firm* — Heslin Rothenberg Farley & Mesiti P.C.

(57) ABSTRACT

A process for manufacturing organic fibers containing an inorganic component comprising the steps of: (1) preparing an inorganic spinnable sol solution; (2) mixing the inorganic spinnable sol solution, a solvent capable of dissolving the inorganic spinnable sol solution, and an organic polymer capable of being dissolved in the solvent to prepare a spinning solution; and (3) spinning the spinning solution to form the organic fibers containing an inorganic component composed of an inorganic gel and the organic polymer, is disclosed. The inorganic spinnable sol solution preferably has a weight average molecular weight of 10,000 or more, and the inorganic spinnable sol solution is preferably prepared from a material containing a metal alkoxide having an organic substituent. According to the process of the present invention, organic fibers containing an inorganic component having an improved mechanical strength can be produced by mixing an inorganic component into an organic component, and a nonwoven fabric containing the fibers can be provided.

4 Claims, 2 Drawing Sheets

U.S. PATENT DOCUMENTS

| | | | | |
|---|---|---|---|---|
| 2008/0226924 | A1* | 9/2008 | Okubo et al. | 428/426 |
| 2009/0285726 | A1* | 11/2009 | Ohshika et al. | 422/179 |
| 2010/0164145 | A1* | 7/2010 | Murakami et al. | 264/433 |
| 2010/0189993 | A1* | 7/2010 | Mori et al. | 428/317.5 |
| 2010/0236697 | A1* | 9/2010 | Yoshimi et al. | 156/188 |

FOREIGN PATENT DOCUMENTS

| | | | |
|---|---|---|---|
| GB | 1530990 | | 11/1978 |
| JP | 411209596 | A * | 8/1999 |
| JP | 2005194675 | | 7/2005 |
| JP | 2007-092238 | | 9/2005 |
| JP | 2007-197859 | | 8/2007 |
| JP | 2008069478 | | 3/2008 |

OTHER PUBLICATIONS

Song, Qiu-sheng et al., Preparation and Characterization of Continuous Fibers of PVA/Si02 Hybrid by Sol-Gel Method, Polymer Materials Science and Engineering, Nov. 2007, vol. 23, No. 6, pp. 216-219, with partial English translation.

Han, Lei, Study on Preparation and Characterization of SiO2/Silicone Hybrid Materials by Sol-Gel Process, China Doctor & Master Theses Full-Text Database (CDMD) (Master Database), Engineering Technology I, Aug. 2005, No. 4, pp. 9-15, with partial English translation.

* cited by examiner

PROCESS FOR MANUFACTURING ORGANIC FIBERS CONTAINING INORGANIC COMPONENT AND NONWOVEN FABRIC CONTAINING THE SAME

CROSS REFERENCE TO RELATED APPLICATIONS

This application claims the priority of Japanese Application No. 2008-099918 filed Apr. 8, 2008. The disclosure of the priority application and all other patents, published applications and other references cited herein are hereby incorporated by reference in their entirety.

TECHNICAL FIELD

The present invention relates to a process for manufacturing organic fibers containing an inorganic component and a nonwoven fabric containing the fibers.

BACKGROUND ART

Fibers having a small fiber diameter can impart various excellent properties, such as a separating property, a liquid-holding capacity, a wiping property, an opacifying property, an insulating property, or flexibility, to a nonwoven fabric, and therefore, it is preferable that a nonwoven fabric is composed of fibers having a small diameter. As a process for manufacturing such fibers having a small fiber diameter, electrospinning is known. In this process, a spinning solution is extruded from a nozzle, and at the same time, an electrical field is applied to the extruded spinning solution to thereby draw the spinning solution, and fibers having a small fiber diameter are spun. When a spinning solution containing an organic polymer is used in electrospinning, fibers made of the organic polymer can be produced.

Such an organic fiber having a small fiber diameter has a low mechanical strength due to its small fiber diameter, and therefore, a nonwoven fabric composed of the organic fibers is hard to handle. The present inventors attempted to improve the mechanical strength of the organic fiber by adding an inorganic component to the organic fiber, together with the addition of a function imparted by the inorganic component.

As a technique to add a function, but not to enhance a mechanical strength, for example, patent literature 1 discloses "a nanofiber having a hetero-phase structure obtained by electrospinning, wherein the hetero-phase structure contains a first phase which extends along with the central axis of a fiber, and a second phase which is arranged at the outside of the first phase, with respect to a cross section vertical to the longitudinal direction of the first phase, and covers the first phase; the first phase is a region made of a first material containing an inorganic material; and the second phase is made of a second material different from the first material". Patent literature 1 also discloses that the nanofibers can be obtained by electrospinning, i.e., by supplying two different types of fluids to a spinneret, and applying a DC voltage between the spinneret and a target. The present inventors carried out the process under conditions that the content of the inorganic material accounted for 10% or less (which is considered to be preferable to enhancing a fiber strength) with respect to the whole mass of the nanofibers, but nanofibers having the two-layered hetero-phase structure could not be obtained, and therefore, the mechanical strength of a nonwoven fabric could not be enhanced.

Neither to enhance a mechanical strength nor to add a function, patent literature 2 discloses "a method for obtaining a fiber structure by extruding a solution prepared by dissolving a fiber-forming solute such as an organic macromolecule or a ceramic precursor compound in a solvent to an electrostatic field generated between electrodes, spinning the solution toward the electrodes, and accumulating formed fibrous substances on a support for capture". Patent literature 2 also discloses in Examples that "ion-exchanged water was added to a solution previously prepared by adding acetic acid to titanium n-butoxide to generate a gel, polyethylene glycol was added to the gel to prepare a spinning solution, and the spinning solution was used to carry out spinning". According to the Examples, fibers comprising an organic component and an inorganic component could be produced, but the inorganic component existed in the fiber as inorganic particles, because the organic component was mixed with the generated gel, and therefore, the mechanical strength of the organic fiber could not be enhanced, and as a result, the mechanical strength of a nonwoven fabric could not be enhanced.

CITATION LIST

Patent Literature

[patent literature 1] Japanese Unexamined Patent Publication (Kokai) No. 2007-197859 (claims 1, 2, 5, and 7 and paragraph [0055])

[patent literature 2] Japanese Unexamined Patent Publication (Kokai) No. 2007-092238 (paragraphs [0008] to [0010] and [0018])

SUMMARY OF INVENTION

Technical Problem

The above problems can be solved by the present invention, and an object of the present invention is to provide a process for manufacturing organic fibers containing an inorganic component, in which a mechanical strength is enhanced by mixing an inorganic component into an organic component, and a nonwoven fabric containing the fibers.

Solution to Problem

The present invention set forth in claim 1 relates to a process for manufacturing organic fibers containing an inorganic component comprising the steps of:

(1) preparing an inorganic spinnable sol solution, (2) mixing the inorganic spinnable sol solution, a solvent capable of dissolving the inorganic spinnable sol solution, and an organic polymer capable of being dissolved in the solvent to prepare a spinning solution, and (3) spinning the spinning solution to form the organic fibers containing an inorganic component composed of an inorganic gel and the organic polymer.

The present invention set forth in claim 2 relates to the process according to claim 1, wherein the inorganic spinnable sol solution has a weight average molecular weight of 10,000 or more.

The present invention set forth in claim 3 relates to the process according to claim 1 or 2, wherein the inorganic spinnable sol solution is prepared from a material containing a metal alkoxide having an organic substituent.

The present invention set forth in claim 4 relates to the process according to any one of claims 1 to 3, wherein the solid content of the inorganic spinnable sol solution accounts for 10% or less with respect to the mass of the organic polymer.

The present invention set forth in claim 5 relates to the process according to any one of claims 1 to 4, wherein the spinning is carried out by the action of an electrical field or by the shearing action of a gas.

The present invention set forth in claim 6 relates to a nonwoven fabric comprising the organic fibers containing an inorganic component prepared by the process of any one of claims 1 to 5.

Advantageous Effects of Invention

According to the present invention set forth in claim 1, organic fibers containing an inorganic component can be spun in a state where a large number of inorganic components which extend along with the longitudinal direction of the fiber are dispersed in the fiber, by mixing the inorganic spinnable sol solution into the organic polymer, and therefore, organic fibers containing an inorganic component which exhibit a mechanical strength higher than that of a fiber made of organic polymers alone can be produced.

According to the present invention set forth in claim 2, fibers can be spun in a state where a large number of inorganic components which extend along with the longitudinal direction of the fiber are dispersed in the fiber, because the inorganic spinnable sol solution has a high molecular weight, and therefore, organic fibers containing an inorganic component which exhibit a mechanical strength higher than that of a fiber made of organic polymers alone can be easily produced.

According to the present invention set forth in claim 3, the inorganic spinnable sol solution is prepared from a material containing a metal alkoxide having an organic substituent, and an inorganic component having an organic substituent exhibits a chemical affinity for an organic polymer, and therefore, organic fibers containing an inorganic component having an enhanced mechanical strength can be easily produced.

According to the present invention set forth in claim 4, the mixing ratio of the inorganic spinnable sol solution to the organic polymer is low, and therefore, organic fibers containing an inorganic component having an enhanced mechanical strength can be easily produced, without impairment of the properties of the organic polymer. Further, organic fibers containing an inorganic component having a fiber diameter similar to that of a fiber made of organic polymers alone can be produced.

According to the present invention set forth in claim 5, even if organic fibers containing an inorganic component, spun by the action of an electrical field or by the shearing action of a gas, have a small fiber diameter, organic fibers containing an inorganic component which exhibit a mechanical strength higher than that of a fiber made of organic polymers alone can be easily produced.

According to the present invention set forth in claim 6, the nonwoven fabric contains the organic fibers containing an inorganic component manufactured by the above process of the present invention, and therefore, exhibits a mechanical strength higher than that of a nonwoven fabric consisting of fibers made of organic polymers alone.

DESCRIPTION OF EMBODIMENTS

Figure 1:
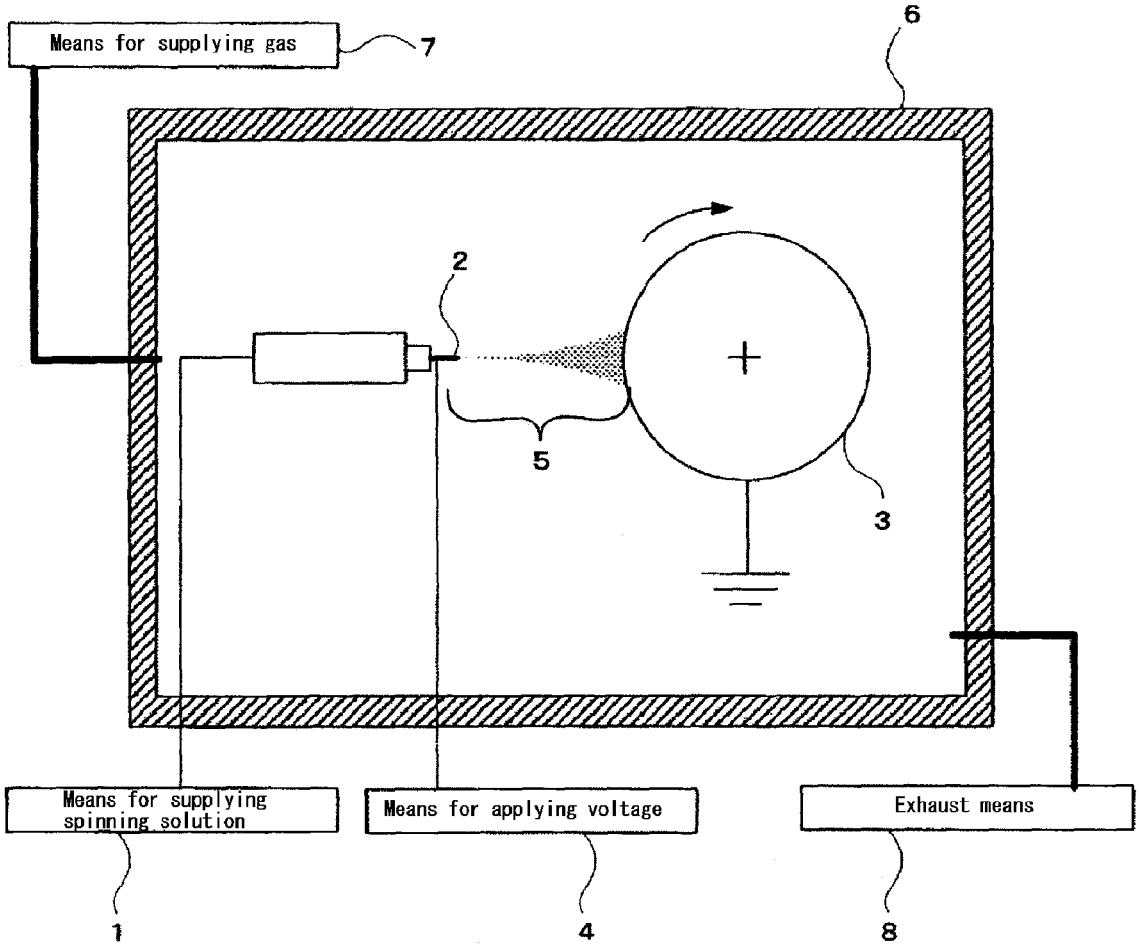
FIG. 1 is a cross-sectional view schematically showing an apparatus for spinning by the action of an electrical field.

First, the step (1) of preparing an inorganic spinnable sol solution (hereinafter sometimes referred to as "sol solution") is carried out in the present invention. In the present invention, the inorganic spinnable sol solution is prepared so that a large number of inorganic components which extend along with the longitudinal direction of an organic fiber containing an inorganic component can be dispersed in the fiber and the mechanical strength of the fiber can be enhanced. The present inventors found that when the inorganic sol solution is "spinnable", a large number of inorganic components which extend along with the longitudinal direction of a fiber obtained by spinning are dispersed in the fiber, and completed the present invention.

The term "inorganic" as used herein means that an inorganic component(s) accounts for 50 mass % or more. The content of the inorganic component(s) contained in the sol solution is preferably 60 mass % or more, more preferably 75 mass % or more. In this regard, the mass ratio (Mr) of the inorganic component(s) means a ratio of a mass (Mg) of gel fibers obtained by spinning the inorganic sol alone with respect to a mass (Mz) of the inorganic sol, i.e., a value calculated by the following equation:

$$Mr=(Mg/Mz)\times 100$$

The property "spinnable" as used herein is judged on the basis of the criteria described below after carrying out electrospinning under the following conditions.

(Method for Judgment)

A solution (solid content: 20 to 50 wt %) to be judged is extruded (amount extruded: 0.5 to 1.0 g/hr) to a grounded metal plate from a metal nozzle (inner diameter: 0.4 mm) which is arranged in a direction perpendicular to the metal plate, and at the same time, a voltage is applied (electric field intensity: 1 to 3 kV/cm, polarity: application of positive voltage or negative voltage) to the nozzle, to continuously spin fibers for a minute or more without solidification of the solution at the tip of the nozzle, and the fibers accumulate on the metal plate.

A scanning electron micrograph of the accumulated fibers is taken and observed. When conditions where fibers having an average fiber diameter (an arithmetic mean value of fiber diameters measured at 50 points) of 5 μm or less and an aspect ratio of 100 or more can be produced without droplets can be found, it is judged that the solution is "spinnable". By contrast, even if one or more of the above conditions (i.e., the content, amount extruded, electric field intensity, and/or polarity) are changed and combined in any combination thereof, when the above conditions cannot be found [for example, a case where there are droplets, a case where each fiber is oily and does not have a definite fibrous shape, a case where the average fiber diameter is more than 5 μm, or a case where the aspect ratio is less than 100 (for example, particles)], it is judged that the solution is "not spinnable".

The sol solution may be obtained by hydrolysis, at approximately 100° C. or less, of a solution (stock solution) of a compound containing one or more elements which will constitute the inorganic component contained in the "organic fibers containing an inorganic component" finally obtained by the process of the present invention, and then condensation polymerization. The solvent of the stock solution may be an organic solvent such as alcohol, or water.

The element contained in the compound is not particularly limited, but examples thereof include lithium, beryllium, boron, carbon, sodium, magnesium, aluminum, silicon, phosphorus, sulfur, potassium, calcium, scandium, titanium, vanadium, chromium, manganese, iron, cobalt, nickel, copper, zinc, gallium, germanium, arsenic, selenium, rubidium, strontium, yttrium, zirconium, niobium, molybdenum, cadmium, indium, tin, antimony, tellurium, cesium, barium, lanthanum, hafnium, tantalum, tungsten, mercury, thallium, lead, bismuth, cerium, praseodymium, neodymium, promethium, samarium, europium, gadolinium, terbium, dysprosium, holmium, erbium, thulium, ytterbium, and lutetium.

Examples of a metal compound which may be used in preparing the spinnable sol solution include an organic metal compound containing the above element, and an inorganic metal compound containing the above element. The organic metal compound may be, for example, a metal alkoxide, a metal acetylacetonate, an acetate, or an oxalate. Examples of a metal element contained in the metal alkoxide include silicon, aluminum, titanium, zirconium, tin, and zinc, and a methoxide, an ethoxide, a propoxide, a butoxide, or the like of these metal elements may be used as the metal alkoxide. For example, when the metal element is silicon, a spinnable sol solution may be prepared by using a silicon alkoxide as a starting material, and performing hydrolysis and condensation polymerization using an acid catalyst.

In this case, it is preferable that a metal alkoxide having one or more organic substituents (such as a methyl group, a propyl group, or a phenyl group) is contained as a material of the inorganic spinnable sol solution, in particular, that a metal alkoxide containing a metal element, two or more hydrolyzable groups, and one or two organic substituents is contained as a material of the inorganic spinnable sol solution, because an inorganic component having a chemical affinity for an organic polymer can be obtained, and therefore, organic fibers containing an inorganic component having an enhanced mechanical strength can be easily produced. Examples of the metal alkoxide include methyl triethoxysilane (MTES), propyl triethoxysilane (PTES), 3-glycidoxypropyl trimethoxysilane (GPTMS), 3-aminopropyl triethoxysilane (APTES), and dimethyl diethoxysilane (DMDES).

When the metal compound which may be used in preparing the spinnable sol solution is a metal alkoxide, a metal alkoxide having one or more organic substituents described above alone, or a metal alkoxide not having such organic substituents alone, or a combination thereof, may be used as a material. In this combination, the mixing ratio is not particularly limited.

The inorganic metal compound may be, for example, a chloride or a nitrate. For example, when the inorganic metal compound is tin oxide, a spinnable sol solution may be prepared by dissolving tin chloride, a starting material, in an alcohol solvent, and performing hydrolysis and condensation polymerization by heating. When the metal element is titanium or zirconium and an alkoxide thereof is used as a starting material, it shows a high reactivity with water, and therefore, a spinnable sol solution may be prepared by using a ligand such as diethanolamine, triethanolamine, acetylacetone, or acetoacetic acid ethyl ester, and selecting an appropriate alcohol solvent and/or an appropriate acid catalyst, to thereby perform hydrolysis and condensation polymerization.

The spinnable sol solution may be prepared by mixing two or more spinnable sol solutions as described above, or using two or more metal compounds.

The spinnable sol solution preferably has a weight average molecular weight of 10,000 or more, from the viewpoint of an excellent spinnability. This is because when the sol solution has such a molecular weight, a large number of inorganic components which extend along the longitudinal direction of the fiber are dispersed in the fiber, and therefore, organic fibers containing an inorganic component having an enhanced mechanical strength can be easily produced. The weight average molecular weight is more preferably 15,000 or more, most preferably 20,000 or more.

The "weight average molecular weight" may be determined by gel permeation chromatography. An inorganic sol solution in the process of hydrolysis and condensation polymerization has unreacted OR groups or OH groups which are chemically active, and there is a possibility that these functional groups may be further polymerized during procedures involved in measurements for structure analysis, and therefore, the gel permeation chromatography may be carried out after the OR or OH groups are protected with trimethylsilyl groups by trimethylsilylization (TMS) to thereby stabilize the inorganic sol [see Journal of the Ceramic Society of Japan, 92, [5], 1984, Kamiya et al.]. That is, in the trimethylsilylization, $Si(CH_3)_3OH$ generated by hydrolysis of a sylylating agent such as trimethylchlorosilane (hereinafter referred to as TMCS) is reacted with an inorganic sol solution in the process of hydrolysis and condensation polymerization, to protect the OR or OH groups with trimethylsilyl groups. It is known that 80 to 90% of the original state of the polymer can be maintained in the stabilized inorganic sol solution [see C. W. Lentz, Long. Chem., 3, 574-79 (1968)]. This trimethylsilylization is not limited to TMCS, and can be carried out by using, for example, trimethylsilylimidazole, N,O-bis(trimethylsilyl)trifluoroacetamide, N,O-bis(trimethylsilyl)acetamide, N-methyl-N-trimethylsilyltrifluoroacetamide, N-trimethylsilyldimethylamine, or N,N-diethylaminotrimethylsilane.

More particularly, with respect to the weight average molecular weight of a silica sol, for example, a mixture of TMCS (60 mL), water (50 mL), and isopropanol (50 mL) is stirred at 25° C. for 2 hours, a silica sol in the process of hydrolysis and condensation polymerization is added to the mixture, and a reaction is carried out by stirring the mixture at 25° C. for 2 days to obtain a two-layered mixing liquid. The upper layer is collected from the resulting mixing liquid, washed with a mixing liquid [water:propanol=1:1 (volume ratio)] twice, and heat-treated at 110° C. using a hot air dryer until a change in weight is no longer observed at 110° C. to evaporate unreacted TMCS, and then the silica sol can be stabilized. The stabilized silica sol can be measured by gel permeation chromatography. This measurement can be carried out using a GPC equipment (HLC-8220GPC, manufactured by Tosoh Corporation), an RI detector (manufactured by Tosoh Corporation) as a detector, and a column Shodex GPC KF-806L×3 (manufactured by Showa Denko K.K.).

Next, the step (2) of mixing the inorganic spinnable sol solution, a solvent capable of dissolving the inorganic spinnable sol solution, and an organic polymer capable of being dissolved in the solvent to prepare a spinning solution is carried out. The order of mixing is not particularly limited, so long as a spinnable spinning solution may be obtained. More particularly, these components may be mixed in a desired order, or two or three components may be simultaneously mixed.

Examples of the solvent include N,N-dimethylformamide (DMF), N,N-dimethylacetamide (DMAc), N-methyl-2-pyrrolidone (NMP), and an alcohol-based solvent (for example, methanol, ethanol, propanol, or isopropanol). The solvent may be appropriately selected in accordance with the organic polymer and the sol solution to be used (in particular, the polymer), that is, a solvent capable of uniformly dissolving the spinnable sol solution and the organic polymer without a phase separation or gelling in the solution is selected.

The organic polymer capable of being dissolved in the solvent is not particularly limited, so long as it is a spinnable resin. Examples of the organic polymer include polyethylene glycol, partially saponified polyvinyl alcohol, completely saponified polyvinyl alcohol, polyvinylpyrrolidone, polylactic acid, polyglycolic acid, polyacrylonitrile, polymethacrylic acid, polymethyl methacrylate, polycarbonate, polystyrene, polyamide, polyimide, polyethylene, polypropylene, polyethersulfone, and polysulfone, and polyacrylonitrile, polyimide, polystyrene, or polyvinylpyrrolidone is preferable.

The molecular weight of the organic polymer is not particularly limited, so long as it is spinnable. For example, when polyacrylonitrile is used, the weight average molecular weight (Mw) is preferably 50,000 to 2,000,000, more preferably 400,000 to 700,000. When polyvinyl alcohol is used, the weight average molecular weight (Mw) is preferably 40,000 to 200,000.

The ratio of the spinnable sol solution to be mixed with respect to the mass of the organic polymer is, as a solid content of the spinnable sol solution, preferably 10% or less, more preferably 5% or less, most preferably 1% or less. This is because when the amount is more than 10%, it tends to become difficult to enhance the mechanical strength of the organic fibers containing an inorganic component. To enhance the mechanical strength of the organic fibers containing an inorganic component by the inorganic component, the amount is preferably 0.01% or more, more preferably 0.1% or more. The ratio (Mr) of the solid content of the spinnable sol solution to the mass of the organic polymer as used herein means a ratio of the solid content mass (Ms) in the spinnable sol solution, with respect to the solid content mass (Mp) of the organic polymer in the spinning solution, i.e., a value calculated by the following equation:

$$Mr=(Ms/Mp)\times 100$$

The concentration of the organic polymer contained in the spinning solution is preferably 1 to 30 wt %, more preferably 5 to 20 wt %, from the viewpoint of an excellent spinnability. For example, when polyacrylonitrile having a weight average molecular weight of 500,000 is used, the optimum concentration is 10 wt %.

The spinning solution used in the present invention preferably has a viscosity of 0.1 Pa·s or more. The term "viscosity" as used herein means a value measured at 25° C. using a viscometer when the shear rate is $100\ s^{-1}$. In this regard, when the spinning solution is prepared, it is not necessary for the sol solution to exhibit spinnability. For example, a sol solution judged as spinnable is diluted, and as a result, even if the diluted sol solution loses the spinnability, such a sol solution may be used in the present invention.

Next, the step (3) of spinning the spinning solution to form the organic fibers containing an inorganic component composed of an inorganic gel and the organic polymer is carried out, to produce the organic fibers containing an inorganic component. This spinning can be performed, for example, by the action of an electrical field or by the shearing action of a gas. According to these method, an excellent effect may be imparted to the present invention, because fibers having a small fiber diameter can be spun. That is, organic fibers containing an inorganic component having a mechanical strength enhanced by the inorganic component, notwithstanding a small fiber diameter, can be spun.

The spinning by an action of an electrical field is the so-called electrospinning, and may be carried out in a conventional method, for example, using an apparatus for electrospinning disclosed in Japanese Unexamined Patent Publication (Kokai) Nos. 2003-73964, 2004-238749, and 2005-194675. Hereinafter, the present invention will be briefly explained on the basis of FIG. 1 showing an apparatus disclosed in Japanese Unexamined Patent Publication (Kokai) No. 2005-194675.

The apparatus shown in FIG. 1 comprises a means for supplying a spinning solution 1 capable of supplying a spinning solution to a nozzle 2; the nozzle 2 capable of extruding the spinning solution supplied by the means for supplying a spinning solution 1; a grounded support 3 for capturing fibers generated by extruding the solution from the nozzle 2 and drawing it by an electrical field; a means for applying a voltage 4 capable of applying a voltage to the nozzle 2 to generate an electrical field between the nozzle 2 and the grounded support 3; a spinning box 6 containing the nozzle 2 and the support 3; a means for supplying a gas 7 capable of supplying a gas having a predetermined relative humidity to the spinning box 6; and an exhaust means 8 capable of exhausting a gas from the spinning box 6. In this apparatus, the spinning solution is supplied to the nozzle 2 by the means for supplying a spinning solution 1. The supplied spinning solution is extruded from the nozzle 2, and at the same time, drawn by an action of the electrical field between the grounded support 3 and the nozzle 2 applied by the means for applying a voltage 4, and spun toward the support 3 while being fiberized (so-called electrospinning). The spun fibers are directly accumulated on the support 3 to form a fiber web.

To continuously accumulate the fibers in this procedure, it is preferable that the support is moved, and the spinning solution is extruded from nozzles which elliptically rotate in a direction perpendicular to the direction of movement of the support (i.e., the direction of movement of the support is perpendicular to the major axis of the elliptical orbit) to accumulate the fiberized fibers on the support.

Figure 2:
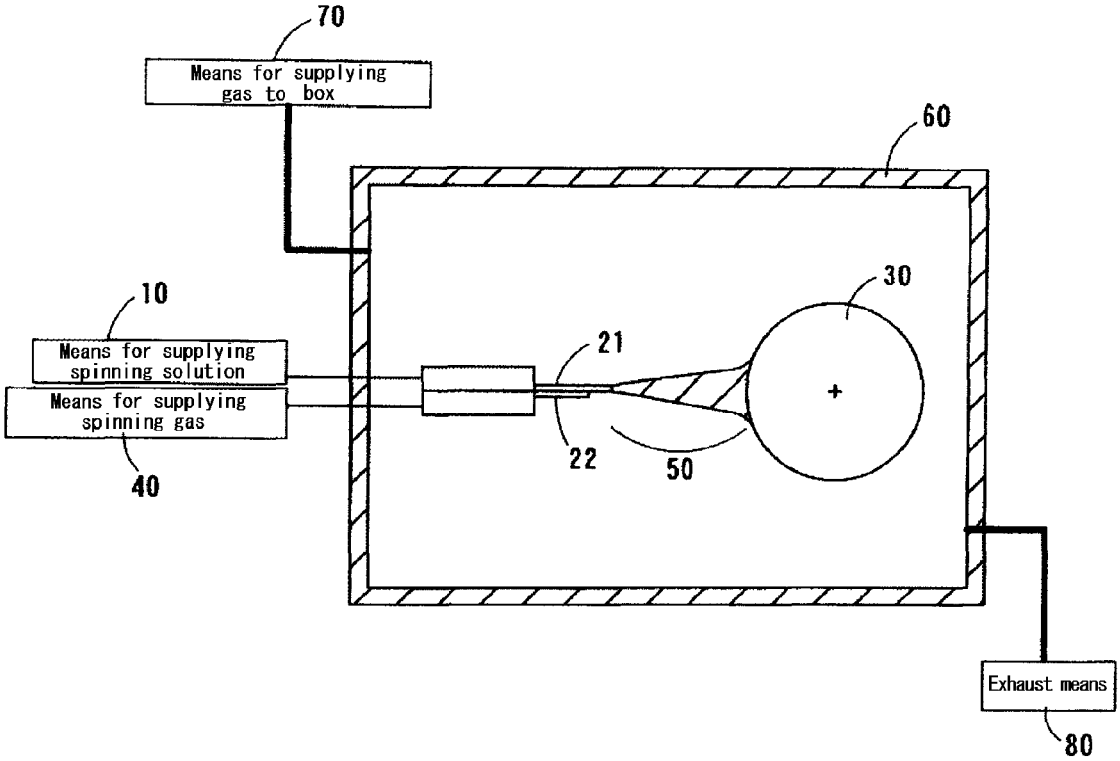
FIG. 2 is a cross-sectional view schematically showing an apparatus for spinning by the shearing action of a gas.

Another spinning by an action of a gas will be briefly explained on the basis of FIG. 2 schematically showing a sectional view of an apparatus.

The apparatus shown in FIG. 2 comprises a means for supplying a spinning solution 10 capable of supplying a spinning solution to a nozzle for extruding a solution 21; the nozzle for extruding a solution 21 capable of extruding the spinning solution supplied by the means for supplying a spinning solution 10; a means for supplying a spinning gas 40 capable of supplying the spinning gas to a nozzle for ejecting a gas 22; the nozzle for ejecting a gas 22 which can eject the gas supplied by the means for supplying a spinning gas 40 and has a nozzle located upstream of the nozzle for extruding a solution 21; a support 30 for capturing fibers generated by extruding the solution from the nozzle for extruding a solution 21 and drawing it by an action of the gas; a spinning box 60 containing the nozzle for extruding a solution 21, the nozzle for ejecting a gas 22, and the support 30; a means for supplying a gas for a box 70 capable of supplying a gas having a predetermined relative humidity to the spinning box 60; and an exhaust means 80 capable of exhausting a gas from the spinning box 60. In this apparatus, the spinning solution is supplied to the nozzle for extruding a solution 21 by the means for supplying a spinning solution 10, and at the same time, a gas is supplied to the nozzle for ejecting a gas 22 by the means for supplying a spinning gas 40. As a result, the spinning solution extruded from the nozzle for extruding a solution 21 is drawn by the shearing action of the gas ejected from the nozzle for ejecting a gas 22, and spun toward the support 30 while being fiberized. The spun fibers are directly accumulated on the support 30 to form a fiber web.

The organic fibers containing an inorganic component can be produced in accordance with the methods described above, but a solvent contained in the spinning solution sometimes remains in the fibers obtained by spinning alone, and therefore, it is preferable that a heat treatment is carried out after spinning to remove the remaining solvent. The remaining solvent may be removed by, for example, an oven, infrared radiation, heated air, or induction heating.

In the organic fibers containing an inorganic component produced by the above methods, a large number of inorganic components which extend along with the longitudinal direction of the fiber are dispersed, and therefore, the organic fibers containing an inorganic component exhibit a mechanical strength higher than that of a fiber made of organic polymers alone. Further, the organic fibers containing an inorganic component have an excellent flexibility because a large number of inorganic components are dispersed in such a state. Furthermore, when the inorganic component has a certain function, the function can be imparted to the fibers.

The nonwoven fabric of the present invention contains the organic fibers containing an inorganic component produced by the methods described above. Therefore, the nonwoven fabric has a mechanical strength higher than that of a conventional nonwoven fabric containing fibers made of organic polymers alone. In particular, a nonwoven fabric consisting of the organic fibers containing an inorganic component (in particular, those spun by the action of an electrical field or by the shearing action of a gas) has a remarkably enhanced mechanical strength.

The nonwoven fabric of the present invention can be produced by, for example, directly accumulating spun fibers. A nonwoven fabric containing materials other than the fibers produced by the methods described above can be produced by adding fibers other than the fibers produced by the methods described above, functional particles, or the like, to the spun fibers or after spinning.

EXAMPLES

The present invention now will be further illustrated by, but is by no means limited to, the following Examples.

Example 1

(1) Preparation of Inorganic Spinnable Sol Solution

Tetraethoxy silane (TEOS), ethanol, water, and hydrochloric acid were mixed at a molar ratio of 1:5:2:0.0025 to prepare a spinnable silica sol solution. More particularly, 2.5 moles of ethanol were mixed with respect to 1 mole of tetraethoxy silane, and a mixture of 2 moles of water, 0.0025 moles of hydrochloric acid, and 2.5 moles of ethanol was further added dropwise thereto with stirring to prepare a starting material. This starting material was reacted at 100° C. and at a stirring speed of 300 rpm for 15 hours while circulating cooling water, and concentrated to a concentration of 44%, as a solid content of silicon dioxide, to prepare a sol solution. The concentrated sol solution was polymerized by maintaining a temperature of 60° C. for several hours to obtain the spinnable silica sol solution (weight average molecular weight: 12,000). This spinnable silica sol solution had a viscosity of 0.32 Pa·s.

(2) Preparation of Spinning Solution

Polyacrylonitrile (Mn=240,000, Mw=480,000) was dissolved in dimethylformamide (DMF) to prepare a 10 wt % solution. The spinnable silica sol solution prepared in (1) was added to the 10 wt % solution so that the solid content of silicon dioxide to the mass of polyacrylonitrile was 1 mass %, to prepare a spinning solution. This spinning solution had a viscosity of 0.9 Pa·s.

(3) Production of Nonwoven Fabric of Organic Fibers Containing Inorganic Component The apparatus shown in FIG. 1 was used as a spinning apparatus. The spinning solution prepared in (2) was pumped to a stainless steel nozzle having an inner diameter of 0.4 mm at a rate of 1 g/h, and extruded from the nozzle to a space for spinning (temperature: 26° C., relative humidity: 23%). At the same time, a voltage (13.5 kV) was applied to the nozzle, and a stainless steel roll (distance between the nozzle tip and the roll: 10 cm) as a support was grounded so that an electrical field was applied to the extruded spinning solution to thereby thin the diameter of the spinning solution, produce silica-containing acrylic fibers, and collect the fibers on the rotating roll, to form a fiber web. The resulting fiber web was subjected to a hot air dryer and heat-treated at 150° C. for 30 minutes to produce a nonwoven fabric. The silica-containing acrylic fibers have an average fiber diameter of 320 nm and a mass per unit area of 5 g/m$^2$.

Example 2

The procedures described in Example 1 were repeated, except that a mixture of tetraethoxy silane (TEOS) and 3-glycidoxypropyl trimethoxysilane (GPTMS) [TEOS: GPTMS=9:1 (molar ratio)] was used as the silica material, and that this silica material, ethanol, water, and hydrochloric acid were mixed at a molar ratio of 1:5:2:0.0025 to prepare a spinnable silica sol solution (weight average molecular weight: 15,000, viscosity: 1.6 Pa·s), to produce a nonwoven fabric (mass per unit area: 5 g/m$^2$) composed of silica-containing acrylic fibers (average fiber diameter: 320 nm). The spinning solution had a viscosity of 0.9 Pa·s.

Example 3

The procedures described in Example 1 were repeated, except that the concentrated sol solution was maintained at 60° C. for 5 hours to obtain a spinnable silica sol solution having an increased molecular weight (weight average molecular weight: 14,000) and a viscosity of 0.56 Pa·s, to produce a nonwoven fabric (mass per unit area: 5 g/m$^2$) composed of silica-containing acrylic fibers (average fiber diameter: 320 nm). The spinning solution had a viscosity of 0.9 Pa·s.

Example 4

The procedures described in Example 2 were repeated, except that the concentrated sol solution was maintained at 60° C. for 5 hours to obtain a spinnable silica sol solution having an increased molecular weight (weight average molecular weight: 21,000) and a viscosity of 2.2 Pa·s, to produce a nonwoven fabric (mass per unit area: 5 g/m$^2$) composed of silica-containing acrylic fibers (average fiber diameter: 320 nm). The spinning solution had a viscosity of 0.9 Pa·s.

Example 5

Tetraethoxy silane (TEOS), butanol, ethanol, water, and hydrochloric acid were mixed at a molar ratio of 1:0.25:2:2:0.01 to prepare a spinnable silica sol solution. More particularly, a mixture of tetraethoxy silane and butanol was stirred at room temperature for 30 minutes to substitute part of the ethoxy groups of tetraethoxy silane with butoxy groups. To this mixture, a mixture of ethanol, water, and hydrochloric acid was added dropwise to prepare a starting material. This starting material was reacted at 100° C. and at a stirring speed of 300 rpm for 7 days while circulating cooling water, and concentrated to a concentration of 44% as a solid content of silicon dioxide to prepare a sol solution. The concentrated sol solution was polymerized by maintaining a temperature of 60° C. for several hours to obtain the spinnable silica sol solution (weight average molecular weight: 20,000). This spinnable silica sol solution had a viscosity of 2.05 Pa·s.

The procedures described in Example 1 were repeated, except that the resulting spinnable silica sol solution was used, to prepare and spin a spinning solution (viscosity: 0.9 Pa·s), and produce a nonwoven fabric (mass per unit area: 5 g/m$^2$) composed of silica-containing acrylic fibers (average fiber diameter: 320 nm).

Example 6

(1) Preparation of Inorganic Spinnable Sol Solution

Tetraethoxy silane (TEOS), zirconium dibutoxy bis(ethylacetoacetate), butanol, water, and hydrochloric acid were mixed at a molar ratio of 0.5:0.5:10:2:0.0025 to prepare a spinnable silica/zirconium mixing sol solution. More particularly, 5 moles of butanol were added to a mixture of 0.5 moles of tetraethoxy silane and 0.5 moles of zirconium dibutoxy bis(ethylacetoacetate), and a mixture of 2 moles of water, 0.0025 moles of hydrochloric acid, and 5 moles of butanol were further added dropwise thereto with stirring to prepare a starting material. This starting material was reacted at 100° C. and at a stirring speed of 300 rpm for 15 hours while circulating cooling water, and concentrated to a concentration of 50%, as a solid content of silicon dioxide and zirconium dioxide, to prepare a sol solution. The concentrated sol solution was polymerized by maintaining a temperature of 60° C. for several hours to obtain the spinnable silica/zirconium sol solution (viscosity: 2.5 Pa·s).

(2) Preparation of Spinning Solution

Polyacrylonitrile (Mn=240,000, Mw=480,000) was dissolved in dimethylformamide (DMF) to prepare a 10 wt % solution. The spinnable silica/zirconium sol solution prepared in (1) was added to the 10 wt % solution so that the total solid content of silicon dioxide and zirconium dioxide to a mass of polyacrylonitrile was 0.5 mass %, to prepare a spinning solution. This spinning solution had a viscosity of 0.9 Pa·s.

(3) Production of Nonwoven Fabric of Organic Fibers Containing Inorganic Component The apparatus shown in FIG. 1 was used as a spinning apparatus. The spinning solution prepared in (2) was pumped to a stainless steel nozzle having an inner diameter of 0.4 mm at a rate of 1 g/h, and extruded from the nozzle to a space for spinning (temperature: 26° C., relative humidity: 23%). At the same time, a voltage (13.5 kV) was applied to the nozzle, and a stainless steel roll (distance between the nozzle tip and the roll: 10 cm) as a support was grounded so that an electrical field was applied to the extruded spinning solution to thereby thin the diameter of the spinning solution, produce silica/zirconium-containing acrylic fibers, and collect the fibers on the rotating roll, to form a fiber web. The resulting fiber web was subjected to a hot air dryer and heat-treated at 150° C. for 30 minutes to produce a nonwoven fabric. The resulting silica/zirconium-containing acrylic fibers have an average fiber diameter of 320 nm and a mass per unit area of 5 g/m$^2$.

Comparative Example 1

Polyacrylonitrile (Mn=240,000, Mw=480,000) was dissolved in dimethylformamide (DMF) to prepare a spinning solution (concentration: 10 wt %, viscosity: 0.9 Pa·s).

The procedures described in Example 1 were repeated, except that this spinning solution was used, to spin acrylic fibers and produce a nonwoven fabric (mass per unit area: 5 g/m$^2$) composed of acrylic fibers (average fiber diameter: 320 nm).

Comparative Example 2

Tetraethoxy silane (TEOS), ethanol, water, and ammonia were mixed at a molar ratio of 1:5:2:0.0025 to prepare an unspinnable silica sol solution. More particularly, 2.5 moles of ethanol were mixed with respect to 1 mole of tetraethoxy silane, and a mixture of 2 moles of water, 0.0025 moles of ammonia, and 2.5 moles of ethanol was further added dropwise thereto with stirring to prepare a starting material. This starting material was reacted at 100° C. and at a stirring speed of 300 rpm for 15 hours while circulating cooling water, and concentrated to a concentration of 44% as a solid content of silicon dioxide to obtain the unspinnable silica sol solution (weight average molecular weight: 3,800). This unspinnable silica sol solution had a viscosity of 0.013 Pa·s.

The procedures described in Example 1 were repeated, except that this unspinnable silica sol solution was used, to prepare a spinning solution (viscosity: 0.9 Pa·s), spin silica-containing acrylic fibers, and produce a nonwoven fabric (mass per unit area: 5 g/m$^2$) composed of the silica-containing acrylic fibers (average fiber diameter: 320 nm).

Comparative Examples 3 and 4

The spinnable silica sol solution prepared by the procedures described in Example 3, and the polyacrylonitrile spinning solution prepared by the procedures described in Comparative Example 1 were provided.

Figure 3:
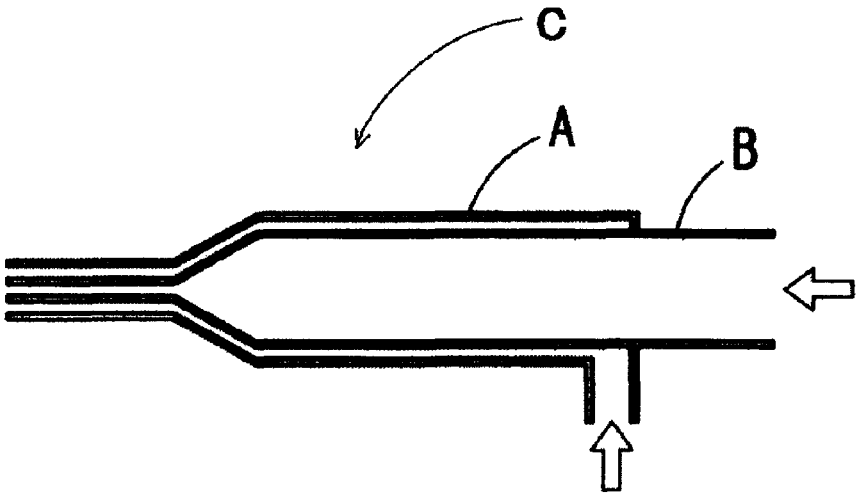
FIG. 3 is a cross-sectional view of the conjugate spinneret C used in Comparative Example 3.

Further, a conjugate spinneret shown in FIG. 3 was provided. More particularly, nozzle A, of which the outer diameter was 0.55 mm and had a circular cross-section having an cross-sectional area of 0.23 mm$^2$, and nozzle B, in which the outer diameter was 0.4 mm and had a circular cross-section section having an cross-sectional area of 0.12 mm$^2$, were provided, and the nozzle B was inserted into the nozzle A so that the central axis of the nozzle A accorded with that of the nozzle B to produce the conjugate spinneret C.

This conjugate spinneret C was used in the spinning apparatus used in Example 1. The polyacrylonitrile spinning solution was supplied to the nozzle A, and the spinnable silica sol solution was supplied to the nozzle B, to spin and collect silica-acrylic core-sheath type composite fibers. In this spinning, the spinning solution was supplied so that a ratio of polyacrylonitrile to the solid of silicon dioxide was 100:1 (polyacrylonitrile:silicon dioxide). The collected fibers were subjected to a hot air dryer and heat-treated at 150° C. for 30 minutes to produce a nonwoven fabric (Comparative Example 3). Scanning electron micrographs (SEM) of the resulting nonwoven fabric were taken at several points, and the cross section of fibers was observed. As a result, portions in which polyacrylonitrile and silicon dioxide were separated, portions composed of polyacrylonitrile alone, or portions composed of silicon dioxide were observed, and each fiber did not have a uniform structure in the longitudinal direction of the fiber.

Next, the spinning solution was supplied so that a ratio of polyacrylonitrile to the solid of silicon dioxide was 100:10 to produce a nonwoven fabric (Comparative Example 4), but no change in the fiber structure was observed.

Measurement of Tensile Strength

The tensile strength of each nonwoven fabric prepared in Examples 1 to 6 and Comparative Examples 1 to 3 was measured using an Instron-type tensile tester (TENSILON™-111-100; manufactured by ORIENTEC, Co.). More particularly, each nonwoven fabric was cut into a rectangle sample of length of 50 mm and width of 15 mm, the sample was fixed to chucks (chuck-to-chuck distance=20 mm) of the tensile tester, the sample was pulled at a constant rate of 50 mm/min, and a maximum tension (tensile strength) was measured when the sample was broken. Each tensile strength was divided by the mass per unit area of each nonwoven fabric to calculate a tensile strength per unit mass per unit area. The results are shown in Table 1. In this measurement, the tensile strength of each nonwoven fabric was measured, but the measured value was actually near to the tensile strength of fibers, because fibers which formed each nonwoven fabric were orientated in the tensile direction when the nonwoven fabric was pulled, and therefore, the breakages occurred not at adhesion points between fibers, but in fibers per se.

TABLE 1

| | PAN % | Sol composition | Sol property | Viscosity of sol Pa/s | Amount added % | Tensile strength N/(g/m$^2$) |
|---|---|---|---|---|---|---|
| Example 1 | 10 | TEOS | spinnable | 0.32 | 1 | 0.404 (104%) |
| Example 2 | 10 | TEOS-GPTMS | spinnable | 1.6 | 1 | 0.420 (108%) |
| Example 3 | 10 | TEOS | spinnable | 0.56 | 1 | 0.409 (106%) |
| Example 4 | 10 | TEOS-GPTMS | spinnable | 2.2 | 1 | 0.473 (122%) |
| Example 5 | 10 | TEOS | spinnable | 2.05 | 1 | 0.528 (136%) |
| Example 6 | 10 | TEOS-ZDBB | spinnable | 2.5 | 0.5 | 0.609 (158%) |
| Comparative Example 1 | 10 | — | — | — | 0 | 0.386 (—) |
| Comparative Example 2 | 10 | TEOS | unspinnable | 0.013 | 1 | 0.330 (85%) |
| Comparative Example 3 | 10 | TEOS | spinnable | 0.56 | 1 | 0.355 (91%) |

In Table 1, "PAN" is a ratio of a solid to polyacrylonitrile, "TEOS" is tetraethoxy silane, "GPTMS" is 3-glycidoxypropyl trimethoxysilane, "ZDBB" is zirconium dibutoxy bis (ethylacetoacetate), "Amount added" is a ratio of sol added, and each number in parentheses of the column "tensile strength is a percentage with respect to the tensile strength of Comparative Example 1, respectively.

It was revealed from a comparison of Examples with Comparative Examples in Table 1 that the mechanical strength of an organic fiber is enhanced by mixing a spinnable sol solution with an organic polymer and carrying out spinning; from a comparison of Example 1 with Example 2 and a comparison of Example 3 with Example 4 that a mechanical strength of organic fibers containing an inorganic component is further enhanced by using a spinnable sol solution containing a metal alkoxide having an organic substituent; and from a comparison between Examples 1, 3, and 5, and a comparison of Example 2 with Example 4 that a mechanical strength of organic fibers containing an inorganic component is further enhanced by using a spinnable sol solution having an increased molecular weight.

INDUSTRIAL APPLICABILITY

According to the present invention, organic fibers containing an inorganic component having an improved mechanical strength can be produced. The organic fibers containing an inorganic component may be applied to, for example, electronic materials, filters for liquid or gas, a carrier for a catalyst, a gas sensor, or medical base materials.

REFERENCE SIGNS LIST

| | |
|---|---|
| 1. | Means for supplying a spinning solution |
| 2. | Nozzle |
| 3. | Support |
| 4. | Means for applying a voltage |
| 5. | Space for spinning |
| 6. | Spinning box |
| 7. | Means for supplying a gas |
| 8. | Exhaust means |

-continued

REFERENCE SIGNS LIST

| | |
|---|---|
| 10. | Means for supplying a spinning solution |
| 21. | Nozzle for extruding a solution |
| 22. | Nozzle for ejecting a gas |
| 30. | Support |
| 40. | Means for supplying a spinning gas |
| 50. | Space for spinning |
| 60. | Spinning box |
| 70. | Means for supplying a gas to a box |
| 80. | Exhaust means |
| A and B. | Nozzles |
| C. | Conjugate spinneret |

The invention claimed is:

1. A process for manufacturing silica-containing organic fibers comprising the steps of:

(1) preparing a spinnable silica sol solution, wherein the spinnable silica sol solution can be used alone to spin fibers, (2) mixing the spinnable silica sol solution, a solvent capable of dissolving the spinnable silica sol solution, and an organic polymer capable of being dissolved in the solvent to prepare a spinning solution, and (3) spinning the spinning solution to form the silica-containing organic fibers composed of a silica-containing gel and the organic polymer, wherein a large number of silica components which extend along with the longitudinal direction of the organic fiber are dispersed in the fiber, and the solid content of the spinnable silica sol solution accounts for 10% or less with respect to the mass of the organic polymer.

2. The process according to claim 1, wherein the spinnable silica sol solution has a weight average molecular weight of 10,000 or more.

3. The process according to claim 1, wherein the spinnable silica sol solution is prepared from a material containing a metal alkoxide having an organic substituent.

4. The process according to claim 1, wherein the spinning is carried out by the action of an electrical field or by the shearing action of a gas.

* * * * *